US011045930B2

(12) United States Patent
Dietze et al.

(10) Patent No.: US 11,045,930 B2
(45) Date of Patent: Jun. 29, 2021

(54) NON-FERROUS FASTENER RETENTION SOCKET

(71) Applicant: GM Global Technology Operations LLC, Detroit, MI (US)

(72) Inventors: Robert H. Dietze, Brighton, MI (US); Christopher Brady, Madison Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 299 days.

(21) Appl. No.: 16/202,166

(22) Filed: Nov. 28, 2018

(65) Prior Publication Data

US 2020/0164494 A1 May 28, 2020

(51) Int. Cl.
*B25B 23/10* (2006.01)
*B25B 21/00* (2006.01)

(52) U.S. Cl.
CPC ..... *B25B 23/108* (2013.01); *B25B 21/002* (2013.01)

(58) Field of Classification Search
CPC ..... B25B 13/06; B25B 13/065; B25B 23/108; B25B 21/002
See application file for complete search history.

(56) References Cited

U.S. PATENT DOCUMENTS 2,805,594 A * 9/1957 Fogel ..... B25B 23/108 81/125
3,005,367 A * 10/1961 Vose ..... B25B 23/065 81/125
3,142,211 A * 7/1964 Faso ..... B25B 23/108 81/125
3,298,410 A 1/1967 Morifuji
3,630,107 A * 12/1971 Carr ..... B25B 23/108 81/125
3,665,791 A 5/1972 Carr
4,581,963 A 4/1986 Kim
4,607,547 A 8/1986 Martus
5,251,520 A * 10/1993 Lanham ..... B25B 13/06 81/124.5
5,323,673 A * 6/1994 Martinez ..... B25B 13/06 81/125
5,361,657 A 11/1994 Terry
5,640,889 A * 6/1997 Anderson ..... B25B 23/065 279/82
6,321,855 B1 * 11/2001 Barnes ..... B25B 13/06 173/132
7,437,975 B1 * 10/2008 De Anfrasio ..... B25B 13/06 81/121.1

(Continued)

FOREIGN PATENT DOCUMENTS

CN 105555482 A 5/2016
DE 10156913 A1 6/2003

(Continued)

*Primary Examiner* — David B. Thomas
(74) *Attorney, Agent, or Firm* — Quinn IP Law

(57) ABSTRACT

A retention socket is configured to hold a non-ferrous metallic fastener and includes a socket body defining a cavity shaped to receive a head of the non-ferrous metallic fastener. The retention socket further includes a mechanical retaining feature coupled to the socket body to removably couple the non-ferrous metallic fastener to the socket body without the aid of magnetic forces.

13 Claims, 2 Drawing Sheets

(56) References Cited

U.S. PATENT DOCUMENTS 7,921,753 B2 * 4/2011 Chen ..... B25B 15/001 81/444
8,984,992 B2 * 3/2015 Newkirk ..... B25B 13/06 81/125
9,038,506 B1 * 5/2015 Huang ..... B25B 13/461 81/60
9,770,815 B2 * 9/2017 Scrivens ..... B25B 13/06
2004/0163500 A1 * 8/2004 Walsh ..... B25B 23/108 81/125
2006/0278050 A1 * 12/2006 Hsiao ..... B25B 23/101 81/451
2007/0245858 A1 * 10/2007 Hu ..... B25B 23/0071 81/125
2010/0294087 A1 11/2010 Hu
2011/0024998 A1 * 2/2011 Nieh ..... B23B 31/1071 279/81
2013/0081521 A1 * 4/2013 Wang ..... B25B 23/105 81/121.1
2013/0129441 A1 * 5/2013 Goss ..... B25B 23/15 411/8
2014/0116203 A1 * 5/2014 Newkirk ..... B25B 13/06 81/54
2016/0193724 A1 * 7/2016 Abel ..... B25B 13/065 81/125
2017/0305001 A1 * 10/2017 Rodriguez ..... B60B 29/003
2017/0341208 A1 11/2017 Koch
2019/0270340 A1 * 9/2019 Rodriguez ..... B25B 13/06
2019/0275649 A1 * 9/2019 Nakagawa ..... B25B 23/106

FOREIGN PATENT DOCUMENTS

DE 202008010206 U1 12/2008
JP S55151471 U 10/1980
JP S57122369 U 7/1982
JP 2006218612 A 8/2006

* cited by examiner

NON-FERROUS FASTENER RETENTION SOCKET

INTRODUCTION

The present disclosure generally relates to retention sockets for nutrunners, and more particularly, a retention socket for holding non-ferrous metallic fasteners, such as aluminum fasteners stainless steel fasteners, titanium fastener, and polymeric fasteners.

Fasteners, such as bolts, may be used to couple two or more components to each other. Some of the fasteners are made of non-ferrous metallic materials or polymeric materials. It is therefore desirable to develop a retention socket configured to retain non-ferrous metallic fasteners and/or polymeric fasteners.

SUMMARY

The present disclosure describes a retention socket configured to removably retain non-ferrous metallic fasteners, such as aluminum fasteners. Non-ferrous metallic fasteners, such as aluminum fasteners, cannot be retained by a magnetic socket for vertical or horizontal applications. Rather, non-ferrous metallic fasteners require manual manipulation to place and engage the threads prior to using the nutrunner. Tight clearances sometimes restrict manual manipulation of the non-ferrous metallic fasteners in fastener locations. For this reason, it is desirable to develop the retention socket to retain non-ferrous metallic fasteners.

The presently disclosed retention socket is configured to hold a non-ferrous metallic fastener and includes a socket body defining a cavity shaped to receive a head of the non-ferrous metallic fastener. The retention socket further includes a mechanical retaining feature coupled to the socket body to removably couple the non-ferrous metallic fastener to the socket body. The mechanical retaining feature may be a snap ring protruding from the socket body toward the cavity to retain the non-ferrous metallic fastener without the aid of magnetic forces. The retention socket may be a hexalobular socket or a hex socket.

In another aspect of the present disclosure, the mechanical retaining feature includes a sleeve disposed over the socket body and a snap ring coupled to the sleeve to hold a flange of the non-ferrous metallic fastener. The sleeve defines a first sleeve end and a second sleeve end opposite the first sleeve end. The snap ring may be closer to the second sleeve end than to the first sleeve end to hold the flange of the non-ferrous metallic fastener. The flange defines a first flange surface and a second flange surface opposite the first flange surface. The first flange surface faces the socket body when the socket body is removably coupled to the non-ferrous metallic fastener. The second flange surface faces away from the socket body when the socket body is removably coupled to the non-ferrous metallic fastener. The snap ring may be closer to the second sleeve end than to the first sleeve end to be in direct contact with the second flange surface, thereby removably coupling the socket body to the non-ferrous metallic fastener. The flange defines a circumferential flange surface interconnecting the first flange surface and the second flange surface. The snap ring may be closer to the second sleeve end than to the first sleeve end to be in direct contact with the circumferential flange surface, thereby removably coupling the socket body to the non-ferrous metallic fastener.

In another aspect of the present disclosure, the mechanical retaining feature may include a collet disposed over the socket body and an O-ring disposed over the collet to hold a flange of the non-ferrous metallic fastener, thereby removably coupling the non-ferrous metallic fastener to the socket body.

In another aspect of the present disclosure, the mechanical retaining feature may include a sleeve defining a sleeve groove, a plurality of balls disposed in the sleeve groove and configured to be in contact with a head of the non-ferrous metallic fastener, and a biasing member disposed in the sleeve groove and in contact with the balls to bias the balls toward the head of the non-ferrous metallic fastener. The socket body defines a body groove aligned with the sleeve groove to allow the balls to be in contact with the head of the non-ferrous metallic fastener.

In another aspect of the present disclosure, the mechanical retaining feature may include a sleeve defining a sleeve recess and a plurality of balls disposed in the sleeve recess and configured to be in contact with a flange of the non-ferrous metallic fastener. The mechanical retaining feature may further include an O-ring disposed in the sleeve recess and in contact with the plurality of balls to bias the plurality of balls toward the flange of the non-ferrous metallic fastener.

The present disclosure also describes a nutrunner including a shaft rotatable about a rotational axis, an electric motor coupled to the shaft, and a retention socket removably coupled to the shaft and configured to hold a non-ferrous metallic fastener. The retention socket includes a socket body defining a socket and a mechanical retaining feature (as described above) coupled to the socket body to removably couple the non-ferrous metallic fastener to the socket body without an aid of magnetic forces.

The above features and advantages and other features and advantages of the present disclosure are readily apparent from the following detailed description of the best modes for carrying out the disclosure when taken in connection with the accompanying drawings.

DETAILED DESCRIPTION

Figure 1:
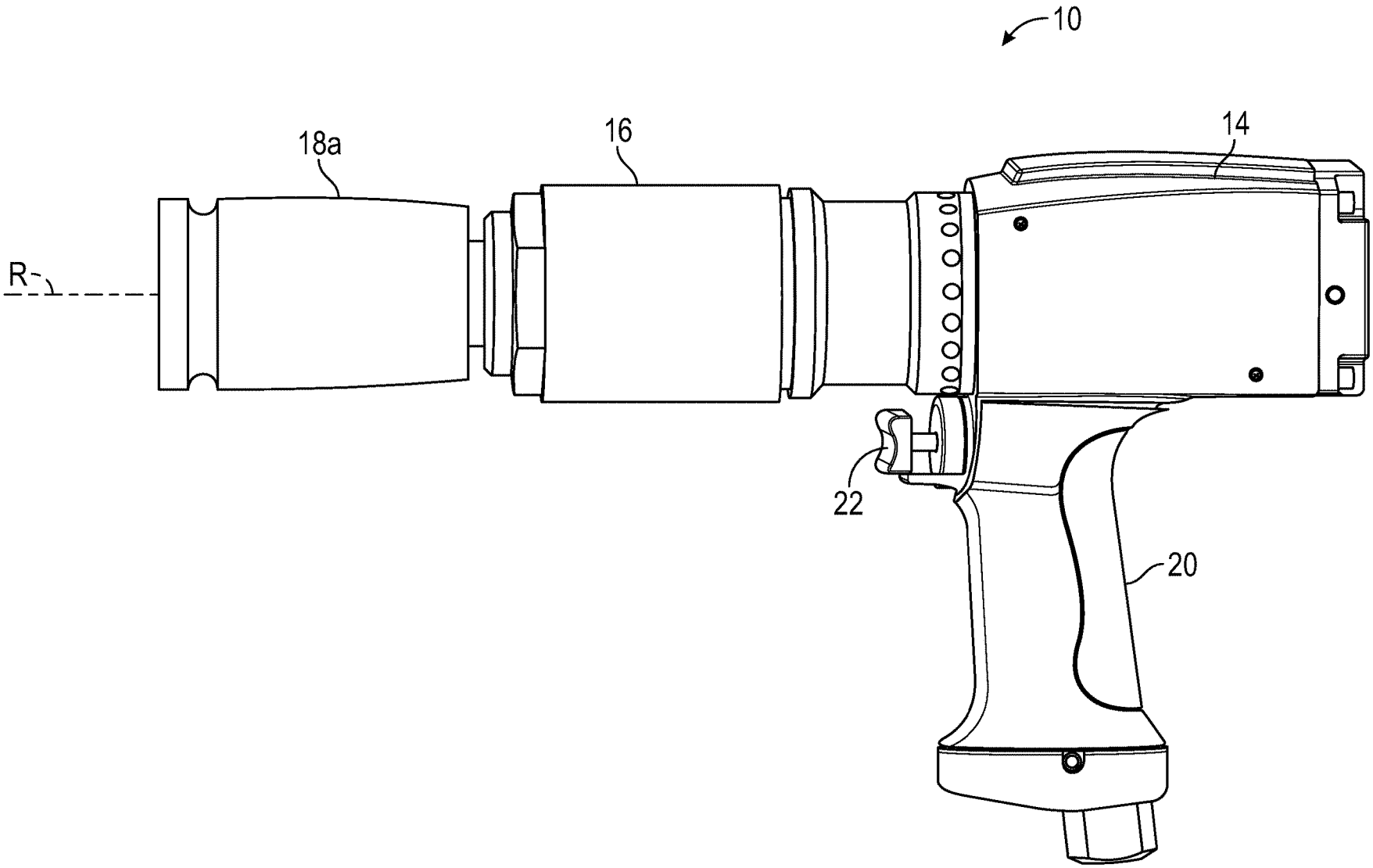
FIG. 1 is a schematic side view of a nutrunner including a retention socket for holding non-ferrous metallic fasteners.

With reference to FIG. 1, a nutrunner 10 is configured to rotate a non-ferrous metallic fastener 12 (FIG. 2) about a rotational axis R in order to couple the non-ferrous metallic fastener 12 to another component. The nutrunner 10 includes an electric motor 14 (or other device capable of rotating the non-ferrous metallic fastener 12, such as a pneumatic system), a tool shaft 16 coupled to the electric motor 14, and a retention socket 18*a* removably coupled to the tool shaft 16.

The nutrunner 10 may also include a handle 20 coupled between the electric motor 14 and the tool shaft 16 and a trigger 22 coupled to the handle 20. The trigger 22 is coupled to the electric motor 14. As such, actuating the trigger 22 causes the electric motor 14 to active, thereby causing rotation of the tool shaft 16 about the rotational axis R. In turn, rotating the tool shaft 16 causes the retention socket 18*a* to rotate about the rotational axis R.

Figure 2:
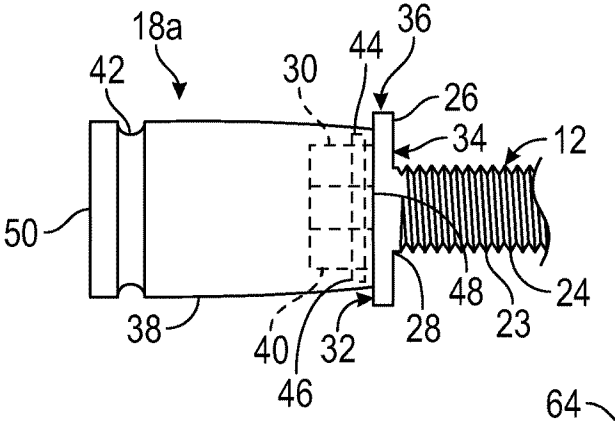
FIG. 2 is a schematic side view of the retention socket shown in FIG. 1, wherein the retention socket includes a snap ring and is coupled to a non-ferrous metallic fastener.

With reference to FIG. 2, the retention socket 18*a* is configured to removably retain non-ferrous metallic fasteners 12. The term "configured to" means "specially designed or constructed to." Non-ferrous metallic fasteners 12, such as aluminum fasteners, cannot be retained by a magnetic socket for vertical or horizontal applications. Rather, non-ferrous metallic fasteners 12 require manual manipulation to place and engage the threads 24 prior to using the nutrunner 10. Tight clearances sometimes restrict manual manipulation of the non-ferrous metallic fasteners in fastener locations. For this reason, it is desirable to develop the retention socket 18*a* to retain non-ferrous metallic fasteners 12.

The non-ferrous metallic fastener 12 is partly or wholly made of non-ferrous metallic material, such as aluminum, and it is non-magnetic. In the depicted embodiment, the non-ferrous metallic fastener 12 is configured as a bolt and includes a threaded shaft 23 including the threads 24. In addition, to the threads 24, the non-ferrous metallic fastener 12 includes a flange 26 at a shaft end 28 of the threaded shaft 23. Accordingly, the flange 26 is directly coupled to the threaded shaft 23. The non-ferrous metallic fastener 12 further includes a head 30 directly coupled to the flange 26. The flange 26 defines a first flange surface 32 and a second flange surface 34 opposite the first flange surface 32. The first flange surface 32 faces the head 30, and the second flange surface 34 faces the threaded shaft 23. The flange 26 further includes a circumferential flange surface 36 directly interconnecting the first flange surface 32 and the second flange surface 34.

The retention socket 18*a* may be a hexalobular socket, a hex socket, or any other suitable type of socket and includes a socket body 38. The socket body 38 defines a cavity 40 configured, shaped, and sized to receive the head 30 of the non-ferrous metallic fastener 12. The socket body 38 defines a tool-engaging recess 42 to facilitate a connection to the tool shaft 16 of the nutrunner 10. The tool-engaging recess 42 may have an annular shape. The retention socket 18*a* further includes a mechanical retaining feature 44 configured to removably couple the non-ferrous metallic fastener 12 without the aid of magnetic forces. The mechanical retaining feature 44 is coupled to the socket body 38 to removably couple the non-ferrous metallic fastener 12 to the socket body 38 without the aid of magnetic forces. The mechanical retaining feature 44 includes a snap ring 46 protruding from the socket body 38 toward the cavity 40 to retain the non-ferrous metallic fastener 12 without the aid of magnetic forces. When the head 30 of the non-ferrous metallic fastener 12 is disposed in the cavity 40 of the retention socket 18*a*, the snap ring 46 directly contacts the head 30 to removably couple the non-ferrous metallic fastener 12 to the retention socket 18*a*. The head 30 of the non-ferrous metallic fastener 12 may include a head groove to facilitate the connection between the non-ferrous metallic fastener 12 and the retention socket 18*a*. The socket body 38 has a first body end 48 and a second body end 50 opposite the first body end 48. The snap ring 46 is disposed closer to the first body end 48 than to the second body end 50 to facilitate the connection between the non-ferrous metallic fastener 12 and the retention socket 18*a*. The tool-engaging recess 42 is closer to the second body end 50 than to the first body end 48 to facilitate the connection between the tool shaft 16 of the nutrunner 10 and the retention socket 18*a*.

Figure 3:
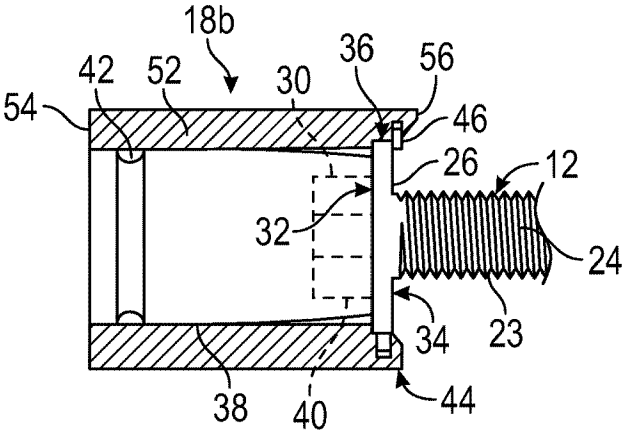
FIG. 3 is a schematic side view of a retention socket including a sleeve and a snap ring.

With reference to FIG. 3, in another aspect of the present disclosure, a retention socket 18*b* is identical to the retention socket 18*a* described above, except for the features described below. The retention socket 18*b* includes a mechanical retaining feature 44 to removably couple the non-ferrous metallic fastener 12 to the socket body 38 without the aid of the magnetic forces. The mechanical retaining feature 44 includes a sleeve 52 disposed over the socket body 38. The sleeve 52 is configured to slide over the socket body 38. The sleeve 52 defines a first sleeve end 54 and a second sleeve end 56 opposite the first sleeve end 54. The mechanical retaining feature 44 further includes a snap ring 46 coupled to the sleeve 52 to hold the flange 26 of the non-ferrous metallic fastener 12. The snap ring 46 is closer to the second sleeve end 56 than to the first sleeve end 54 to hold the flange 26 of the non-ferrous metallic fastener 12. The snap ring 46 is also closer to the second sleeve end 56 than to the first sleeve end 54 of the sleeve 52 to be in direct contact with the second flange surface 34, thereby removably coupling the socket body 38 to the non-ferrous metallic fastener 12. By being in direct contact with the second flange surface 34 of the flange 26, the snap ring 46 captures the head 30 of the non-ferrous metallic fastener 12. The first flange surface 32 faces the socket body 38 when the socket body 38 is removably coupled to the non-ferrous metallic fastener 12, and the second flange surface 34 faces away from the socket body 38 when the socket body 38 is removably coupled to the non-ferrous metallic fastener 12. The snap ring 46 may additionally or alternatively be closer to the second sleeve end 56 than to the first sleeve end 54 of the sleeve 52 to be in direct contact with the circumferential flange surface 36 of the flange 26, thereby removably coupling the socket body 38 to the non-ferrous metallic fastener 12. By being in direct contact with the circumferential flange surface 36, the snap ring 46 applies a clamping load on the flange 26, thereby removably coupling the socket body 38 to the non-ferrous metallic fastener 12.

Figure 4:
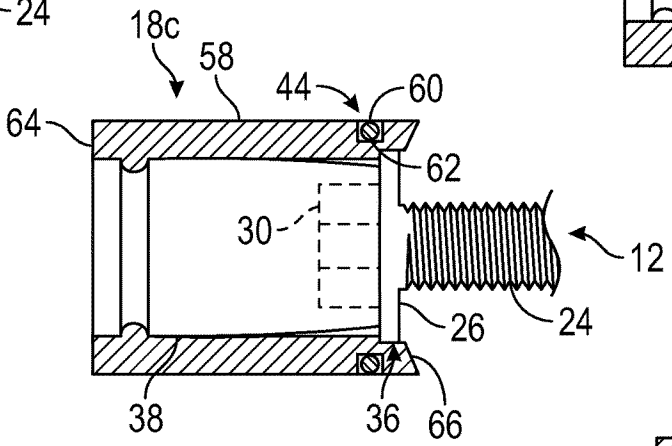
FIG. 4 is a schematic side view of a retention socket including a collet and an O-ring, providing a friction clamp load on the fastener head.

With reference to FIG. 4, in another aspect of the present disclosure, a retention socket 18*c* is identical to the retention socket 18*a* described above, except for the features described below. The mechanical retaining feature 44 of the retention socket 18*c* includes a collet 58 disposed over the socket body 38. The term "collet" means a segmented sleeve (with slots) that is disposed around a component, such as the socket body 38, to apply a clamping force to that component. The collet 58 is configured to slide over the socket body 38. The mechanical retaining feature 44 includes an O-ring 60 disposed over the collet 58 to hold the flange 26 of the non-ferrous metallic fastener 12, thereby removably coupling the non-ferrous metallic fastener 12 to the socket body 38. The collet 58 defines a collet recess 62 configured, shaped, and sized to receive the O-ring 60. The collet recess 62 may have an annular shape to receive the O-ring 60. The collet 58 has a first collet end 64 and a second collet end 66 opposite the first collet end 64. The collet recess 62 may be closer to the second collet end 66 than to the first collet end 64 to allow the collet 58 to be in direct contact with the circumferential flange surface 36 of the flange 25 (under the clamping force applied by the O-ring 60) to retain the head 30 of the non-ferrous metallic fastener 12 without the aid of magnetic forces.

Figure 5:
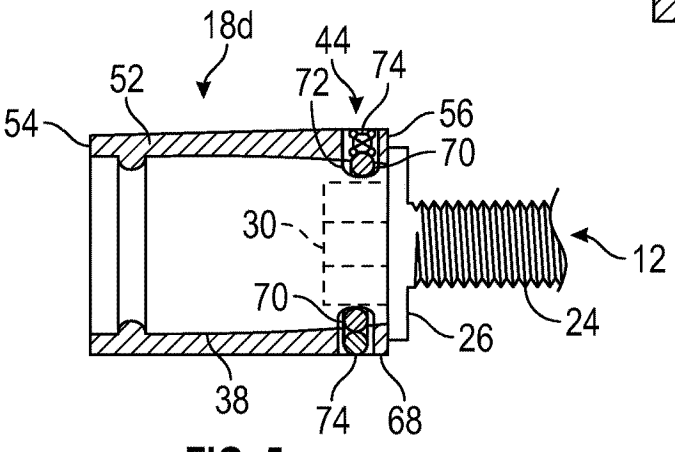
FIG. 5 is a schematic side view of a retention socket including a sleeve and a biasing member, providing a friction clamp load on or under the fastener flange.

With reference to FIG. 5, in another aspect of the present disclosure, a retention socket 18*d* is identical to the retention socket 18*a* described above, except for the features described below. In FIG. 5, a ball plunger retention method is employed. The mechanical retaining feature 44 of the retention socket 18*d* includes a sleeve 52 configured to be disposed over the socket body 38. In particular, the sleeve 52 is configured to slide over the socket body 38. The sleeve 52 defines a sleeve groove 68 that extends through the entire thickness of the sleeve 52. Thus, the sleeve groove 68 is a thru-hole and may have an annular shape. The mechanical retaining feature 44 further includes a plurality of balls 70 partly disposed in the sleeve groove 68 and configured to be in direct contact with the head 30 of the non-ferrous metallic fastener 12. The socket body 38 defines a body groove 72 aligned with the sleeve groove 68 to allow the balls 70 to be in direct contact with the head 30 of the non-ferrous metallic fastener 12 to capture the head 30 of the non-ferrous metallic fastener 12 without the aid of magnetic forces. The mechanical retaining feature 44 further includes a biasing member 74 disposed in the sleeve groove 68 and in direct contact with the balls 70 to bias the balls 70 toward the head 30 of the non-ferrous metallic fastener 12, thereby coupling the retention socket 18*d* to the non-ferrous metallic fastener 12 without the aid of the magnetic forces. The biasing member 74 may be configured as an O-ring 60 and/or a plurality of springs embedded in the sleeve groove 68. As such, the biasing member 74 and the balls 70 collectively form ball plungers configured to capture the head 30 of the non-ferrous metallic fastener 12. The sleeve 52 and the socket body 38 may be integrally coupled to each other to enhance its structural integrity. As such, the sleeve 52 and the socket body 38 may be a one-piece structure. In other words, the retention socket 18*d* may include a thick wall socket body 38.

Figure 6:
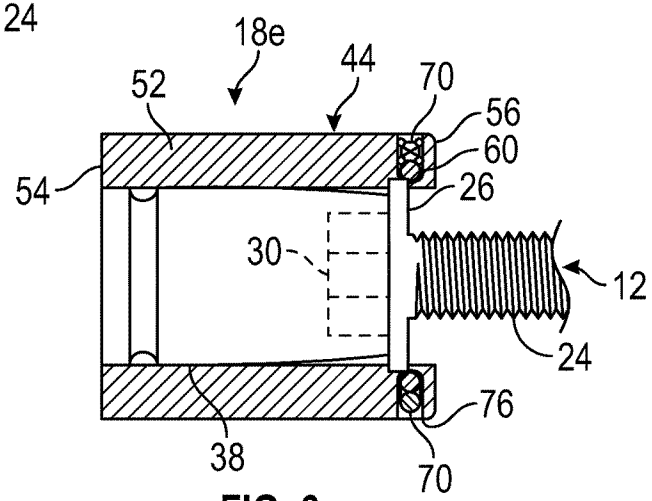
FIG. 6 is a schematic side view of a retention socket including a sleeve and balls to provide a compressive force on the ferrous metallic fastener.

With reference to FIG. 6, in another aspect of the present disclosure, a retention socket 18*e* is identical to the retention socket 18*a* described above, except for the features described below. In FIG. 6, the ball plunger retention method as in FIG. 5 is employed. The mechanical retaining feature 44 of the retention socket 18*e* includes a sleeve 52 defining a sleeve recess 76. Further, the mechanical retaining feature 44 includes a plurality of balls 70 disposed in the sleeve recess 76. The balls 70 are annularly arranged around the sleeve 52 (in the sleeve recess 76). For this reason, the sleeve 76 has an annular shape to accommodate the balls 70. The mechanical retaining feature 44 further includes an O-ring 60 disposed in the sleeve recess 76 and in direct contact with the plurality of balls 70 to bias the plurality of balls 70 toward the flange 26 of the non-ferrous metallic fastener 12, thereby coupling the retention socket 18*e* to the non-ferrous metallic fastener 12 without the aid of magnetic forces. The sleeve recess 76 is closer to the second sleeve end 56 than to the first sleeve end 54 to allow the O-ring 60 to be in direct contact with the flange 26 of the non-ferrous metallic fastener 12. The sleeve 52 and the socket body 38 may be integrally coupled to each other to enhance its structural integrity. As such, the sleeve 52 and the socket body 38 may be a one-piece structure. In other words, the retention socket 18*e* may include a thick wall socket body 38. The O-ring 60 and the balls 70 collectively form ball plungers configured to exert compressive forces on the head 30 of the non-ferrous metallic fastener 12, thereby retaining the non-ferrous metallic fastener 12 without the aid of magnetic forces.

While the best modes for carrying out the disclosure have been described in detail, those familiar with the art to which this disclosure relates will recognize various alternative designs and embodiments for practicing the disclosure within the scope of the appended claims. For example, each of the retention sockets 18*a*, 18*b*, 18*c* 18*d*, and 18*e* may be removably coupled to the tool shaft 16 of the nutrunner 10.

What is claimed is:

1. A retention socket for holding a non-ferrous metallic fastener, comprising:

a socket body defining a cavity shaped to receive a head of the non-ferrous metallic fastener;

a mechanical retaining feature coupled to the socket body to removably couple the non-ferrous metallic fastener to the socket body; and wherein the mechanical retaining feature is a snap ring protruding from the socket body toward the cavity to retain the non-ferrous metallic fastener without the aid of magnetic forces.

2. The retention socket of claim 1, wherein the retention socket is a hexalobular socket.

3. The retention socket of claim 1, wherein the retention socket is a hex socket.

4. A retention socket for holding a non-ferrous metallic fastener, comprising:

a socket body defining a cavity shaped to receive a head of the non-ferrous metallic fastener; and a mechanical retaining feature coupled to the socket body to removably couple the non-ferrous metallic fastener to the socket body;

wherein the mechanical retaining feature includes:

a sleeve disposed over the socket body; and a snap ring coupled to the sleeve to hold a flange of the non-ferrous metallic fastener.

5. The retention socket of claim 4, wherein the sleeve defines a first sleeve end and a second sleeve end opposite the first sleeve end, and the snap ring is closer to the second sleeve end than to the first sleeve end to hold the flange of the non-ferrous metallic fastener.

6. The retention socket of claim 5, wherein the flange defines a first flange surface and a second flange surface opposite the first flange surface, the first flange surface faces the socket body when the socket body is removably coupled to the non-ferrous metallic fastener, the second flange surface faces away from the socket body when the socket body is removably coupled to the non-ferrous metallic fastener, and the snap ring is closer to the second sleeve end than to the first sleeve end to be in direct contact with the second flange surface, thereby removably coupling the socket body to the non-ferrous metallic fastener.

7. The retention socket of claim 6, wherein the flange defines a circumferential flange surface interconnecting the first flange surface and the second flange surface, and the snap ring is closer to the second sleeve end than to the first sleeve end to be in direct contact with the circumferential flange surface, thereby removably coupling the socket body to the non-ferrous metallic fastener.

8. A nutrunner, comprising:

a shaft rotatable about a rotational axis;

an electric motor coupled to the shaft;

a retention socket removably coupled to the shaft and configured to hold an non-ferrous metallic fastener, wherein the retention socket includes:

a socket body defining a socket; and a mechanical retaining feature coupled to the socket body to removably couple the non-ferrous metallic fastener to the socket body without an aid of magnetic forces;

wherein the mechanical retaining feature includes:

a sleeve defining a sleeve recess;

a plurality of balls disposed in the sleeve recess and configured to be in contact with a flange of the non-ferrous metallic fastener; and an O-ring disposed in the sleeve recess and in contact with the plurality of balls to bias the plurality of balls toward the flange of the non-ferrous metallic fastener.

9. The nutrunner of claim 8, wherein the retention socket is a hexalobular socket.

10. The nutrunner of claim 8, wherein the retention socket is a hex socket.

11. The nutrunner of claim 8, wherein the socket body is a one-piece structure.

12. The nutrunner of claim 8, wherein the plurality of balls are annularly arranged around the sleeve recess.

13. The nutrunner of claim 8, wherein the O-ring and the plurality of balls collectively form ball plungers configured to exert compressive forces on the non-ferrous metallic fastener.

* * * * *